US007931225B2

(12) United States Patent
Wang

(10) Patent No.: US 7,931,225 B2
(45) Date of Patent: Apr. 26, 2011

(54) WATER HOSE WINDING DEVICE

(76) Inventor: Hsin-Fa Wang, Chang Hua Hsien (TW)

( * ) Notice: Subject to any disclaimer, the term of this patent is extended or adjusted under 35 U.S.C. 154(b) by 98 days.

(21) Appl. No.: 12/469,617

(22) Filed: May 20, 2009

(65) Prior Publication Data

US 2010/0294872 A1 Nov. 25, 2010

(51) Int. Cl.
*B65H 75/48* (2006.01)

(52) U.S. Cl. ..... 242/390; 242/397.2; 242/397.3; 137/355.21

(58) Field of Classification Search ..... 242/390, 242/390.2–390.3; 137/355.26, 355.16, 355.2; 251/129.04
See application file for complete search history.

(56) References Cited

U.S. PATENT DOCUMENTS 4,513,772 A * 4/1985 Fisher ..... 137/355.22
5,947,148 A * 9/1999 DeVito ..... 137/355.26
6,092,548 A * 7/2000 DeVito ..... 137/351
7,121,495 B2 * 10/2006 Caamano ..... 242/390.5
7,363,679 B2 * 4/2008 Zimmerle et al. ..... 15/315
7,503,338 B2 * 3/2009 Harrington et al. ..... 137/355.2
2003/0116670 A1 * 6/2003 Gentry ..... 242/389
2006/0186254 A1 * 8/2006 Handley et al. ..... 242/390.8

* cited by examiner

*Primary Examiner* — Sang Kim
(74) *Attorney, Agent, or Firm* — Egbert Law Offices PLLC

(57) ABSTRACT

The present invention provides a water hose winding device. The winding device main body includes a water hose winding rack, a water inlet adapter, a water hose exit guide hole, a driving motor, and a gearing component. The water outlet end of the water hose is configured with a wireless winding control mechanism, which includes a radio signal transmitter and a control switch. The winding device main body is configured with a radio signal receiver to receive the wireless control signal transmitted by the radio signal transmitter, and the driving end radio signal receiver is electrically connected to the driving motor. When the driving end radio signal receiver receives the wireless control signal, it can start or shut off the driving motor.

3 Claims, 8 Drawing Sheets

WATER HOSE WINDING DEVICE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a water hose winding device, and more particularly to an innovative winding device with a wireless winding control mechanism configured on the water outlet end of the water hose and a radio signal receiver configured on the main body of the winding device.

2. Description of Related Art Including Information Disclosed under 37 CFR 1.97 and 37 CFR 1.98.

During gardening and irrigation work, a water hose is a necessary support tool for manual water spraying. Through the water hose, the water tap can be extended to different places of various distances for water spraying and irrigation. During this process, the water hose may be stretched or bent due to the advance or retreat of the user, and as a result, the water hose may easily get tangled and the water flow may be blocked. Based on this problem, relevant manufacturers have developed a kind of water hose winding device to solve the above problem.

In the structure of the prior art water hose winding device, a winding shaft is provided on a rack structure for winding of the water hose. On the exterior of the winding shaft, a hand crank is configured for operation by the user to drive the winding shaft. Through such a device, the water hose can be wound on the outside of the winding shaft in an orderly manner when it is not used. When the water hose is to be used, it can be directly pulled out and extended to different places. To retrieve the water hose, the user can operate the hand crank to drive the winding shaft to rotate in the opposite direction, and to wind up the water hose. However, during usage of such a manual water hose winding device, if the water hose is extended to a long distance, the user has to manually wind the pipe for a long time to collect the pipe, and therefore it is very inconvenient and strenuous. Based on this problem, relevant manufacturers further developed a kind of electric water hose winding device to overcome the above problem.

In this kind of water hose winding device, a driving device is configured on a corresponding position of the winding shaft, so that the winding shaft can be driven in a mechanical manner instead of the manual manner. Meanwhile, a control switch is configured on the frame of the water hose winding device. When the user wants to wind up the water hose, the control switch can be operated to activate the driving device.

However, it is found that such a prior art electric water hose winding device still has problems.

The control switch of the driving device is configured on the frame structure of the water hose winding device. When the user pulls out the water hose to use, the frame remains unmoved, but the position of the user is farther and farther from the frame along with extension of the water hose. Therefore, when the user needs to wind up the water hose later, he must walk back to the position of the frame to operate the control switch. This is obviously inefficient and inconvenient. Also, if the user has pulled the water hose to a long distance and wants to wind back the pipe for a certain length, he has to walk back to the position of the frame to operate the control switch. This is obviously a very inconvenient thing. Moreover, once the user walks back to the position of the frame, he cannot control or adjust the winding status of the pull-out end of the water hose in real time, and it is very likely that the water hose gets tangled or jammed. Hence, such a prior art structure obviously cannot perfectly meet the demand of users and shall be improved.

BRIEF SUMMARY OF THE INVENTION

There are advancements of efficacy of the present invention.

The water hose winding device disclosed in the present invention adopts an innovative and unique structure with the water outlet end of the water hose configured with a wireless winding control mechanism. Correspondingly, the winding device main body is configured with a radio signal receiver. As the water outlet end of the water hose is the part frequently gripped by the hand of the user, the water hose winding can be directly controlled by turning on/off the control switch on the water outlet end of the water hose. Based on this innovation, a practical advancement can be achieved in that the usage is more convenient and efficient. Moreover, during winding of the water hose, the user is still nearby the water outlet end of the water hose, therefore the winding status of the water hose can be more easily controlled or adjusted, and problems like tangling or jamming of the water hose during winding can be more easily avoided.

The present invention can have the following new efficacies:

1. Through configuration of the water hose guiding slider, during winding, the water hose can have ordinal and transverse motion, so that the water hose can be wound on the water hose winding rack evenly and orderly.

2. Based on the configuration that the gearing component is composed of the first bevel gear, second bevel gear, clutch bevel gear, and solenoid valve, when the user wants to pull out the water hose, as the clutch bevel gear is disengaged from the first and second bevel gear, the water hose winding rack can rotate independently without influence from the motion transmission status of the first bevel gear, driving motor, and clutch bevel gear, the water hose can be pulled out with less effort.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
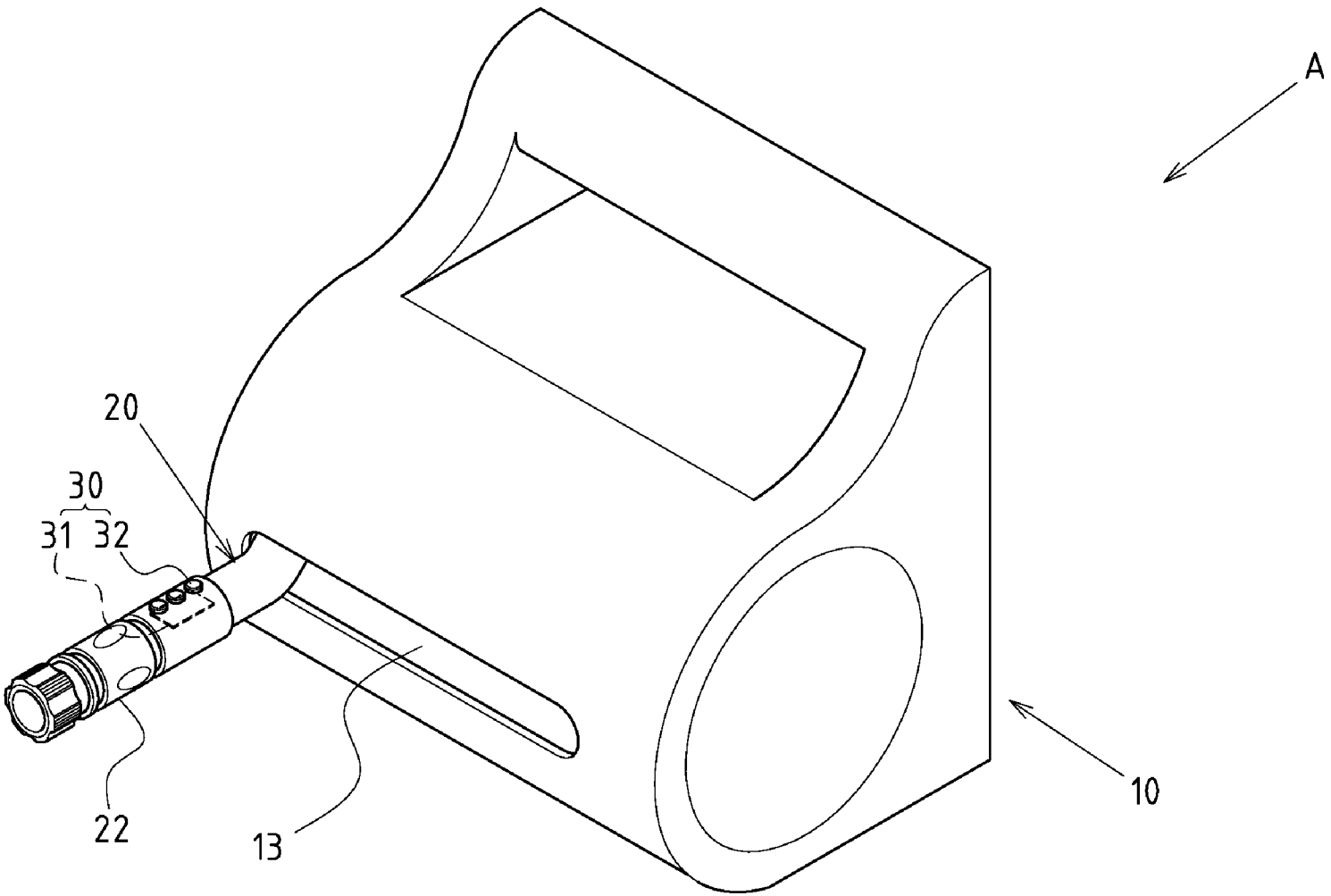
FIG. 1 is a perspective view of a preferred embodiment of the water hose winding device of the present invention.

FIGS. 1, 2, 3, and 4 depict a preferred embodiment of the water hose winding device disclosed in the present invention. While such an embodiment is for descriptive purposes only, the patent application shall not be restricted to such a structure.

The water hose winding device A comprises a winding device main body 10, which includes a water hose winding rack 11, a water inlet adapter 12, a water hose exit guide hole 13, a driving motor 14, and a gearing component 15. The water hose winding rack 11 is transversely riveted on the winding device main body 10 in a rotatable manner. The driving motor 14 drives the gearing component 15, and the gearing component 15 drives the water hose winding rack 11 to rotate. The water hose exit guide hole 13 is configured in a narrow shape that extends transversely.

The device A further comprises a water hose 20, which includes a connection end 21 and a water outlet end 22. The connection end 21 is connected to the water inlet adapter 12 of the winding device main body 10, and the water outlet end 22 goes through and extends out of the water hose exit guide hole 13 of the winding device main body 10. The pipe body 23 of the water hose 20 between the connection end 21 and the water outlet end 22 can be wound on the exterior of the water hose winding rack 11.

The device A also comprises a wireless winding control mechanism 30, which is configured on the water outlet end 22 of the water hose 20. The wireless winding control mechanism 30 includes a radio signal transmitter 31 and at least one control switch 32. Through operation on the control switch 32, the radio signal transmitter 31 can transmit a wireless control signal W (refer to FIG. 4).

The device A comprises a driving end radio signal receiver 40, which can be configured nearby the driving motor 14 on the winding device main body 10. The driving end radio signal receiver 40 is to receive the wireless control signal W transmitted by the radio signal transmitter 31. And the driving end radio signal receiver 40 is electrically connected to the driving motor 14. When the driving end radio signal receiver 40 receives the wireless control signal W, the driving motor 14 can be started or stopped.

Figure 2:
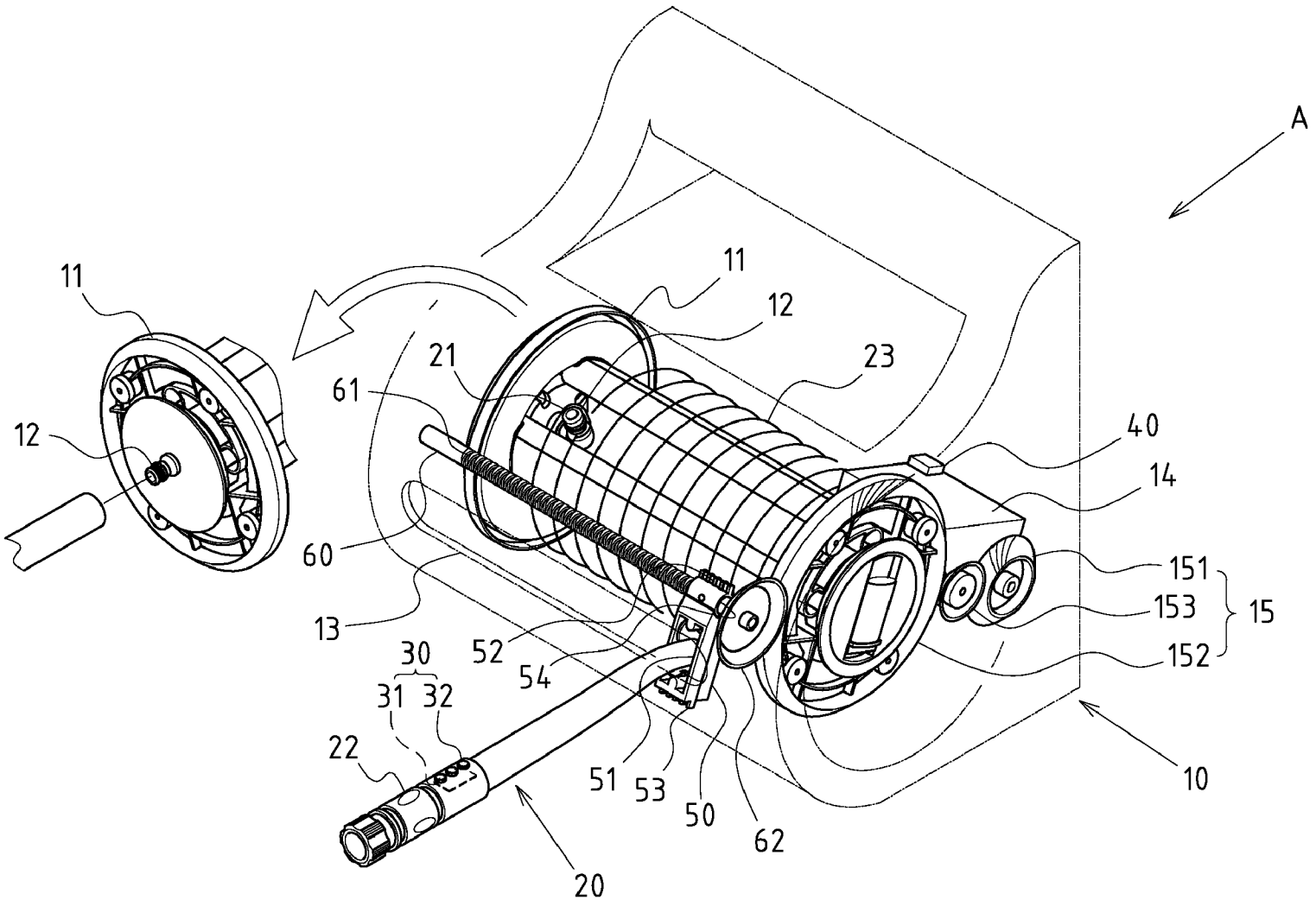
FIG. 2 is a perspective view of the inner structure of a preferred embodiment of the water hose winding device of the present invention.
Figure 3:
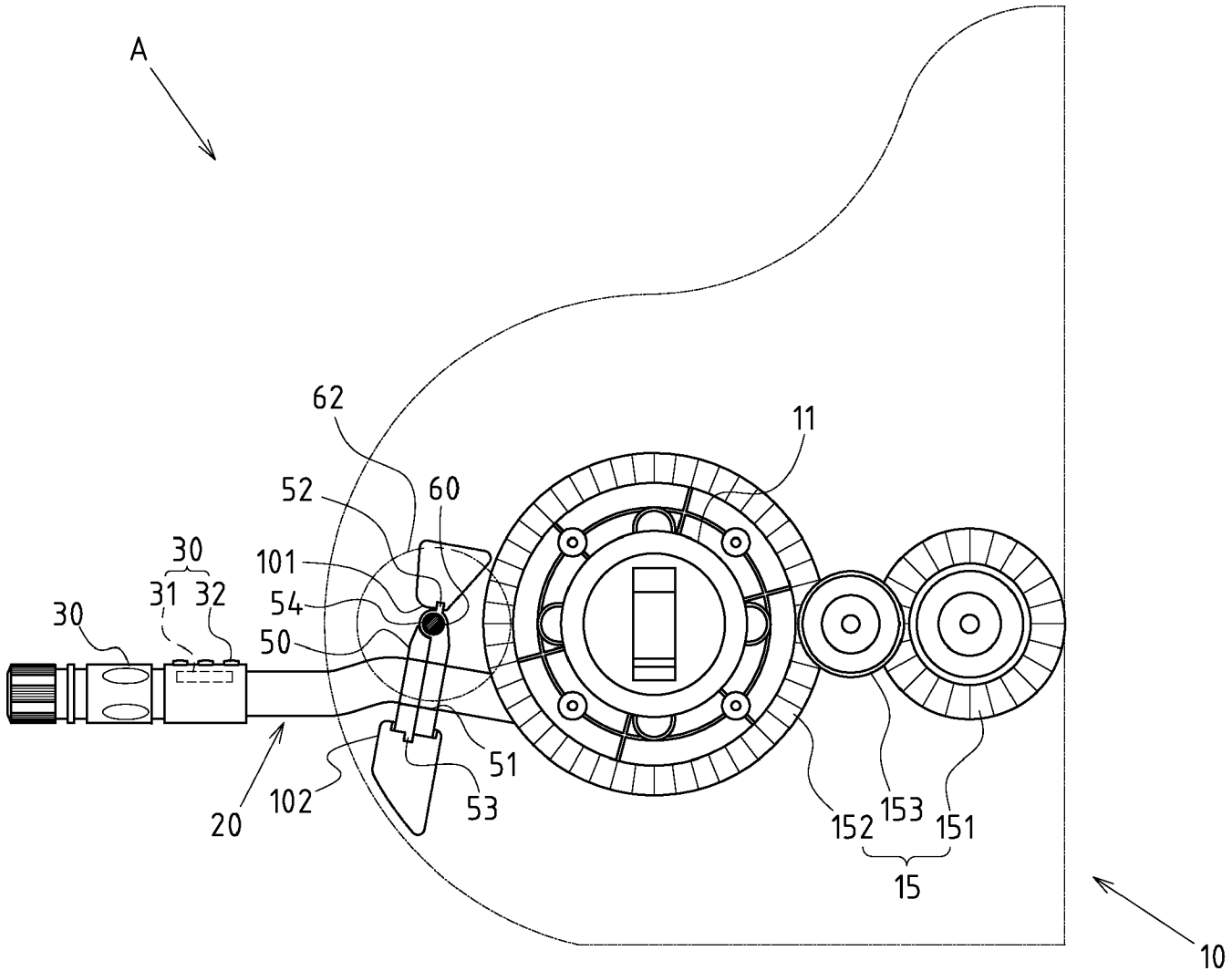
FIG. 3 is a side elevation view of the inner structure of a preferred embodiment of the water hose winding device of the present invention.

Furthermore, referring to FIGS. 2 and 3, inside the water hose exit guide hole 13 of the winding device main body 10, a water hose guiding slider 50 is configured. The water hose guiding slider 50 has a through hole 51 for the water hose 20 to go through. The top and bottom ends of the water hose guiding slider 50 are respectively configured with an upper sliding support 52 and a lower sliding support 53. The winding device main body 10 is configured with an upper track 101 and a lower track 102 to guide the upper sliding support 52 and lower sliding support 53 of the water hose guiding slider 50. Moreover, a driven through hole 54 is configured transversely on one end of the water hose guiding slider 50, and the winding device main body 10 is correspondingly configured with a driving shaft 60 with bi-directional screws 61. The driven through hole 54 holds the driving shaft 60, and one end of the driving shaft 60 is configured with a driven part 62 (configured as a bevel gear in the present embodiment). The driven part 62 can be driven by the gearing component 15 to rotate, and when the driving shaft 60 rotates, through matching between the bi-directional screws 61 and the driven through hole 54, the water hose guiding slider 50 can slide to and fro transversely. The purpose of configuration of the water hose guiding slider 50 is mainly to achieve orderly transverse displacement of the water hose 20 during winding through the transverse reciprocal sliding of the water hose guiding slider 50, so that the water hose 20 can be evenly and orderly wound on the water hose winding rack 11.

Figure 6:
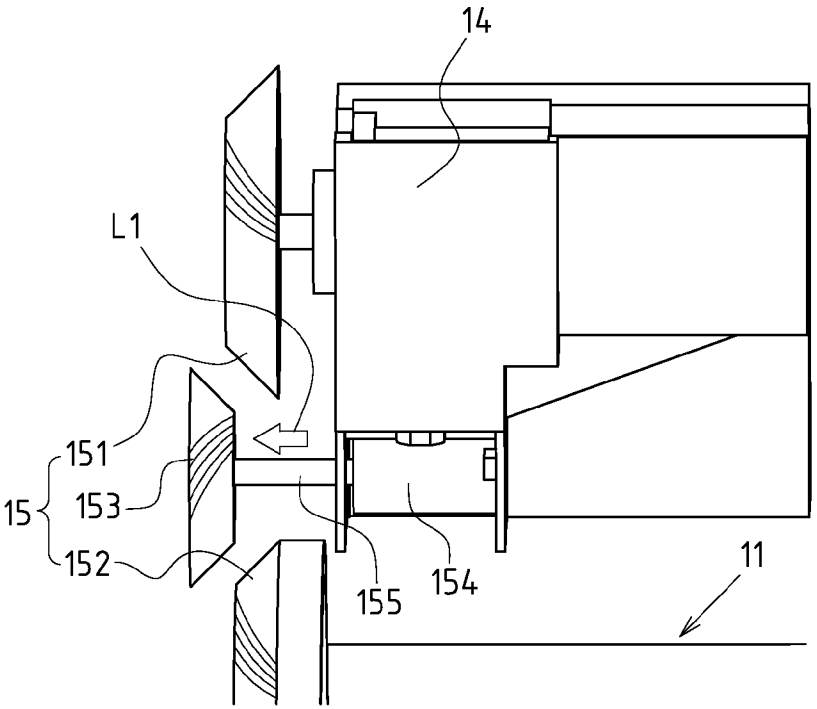
FIG. 6 is an elevation view of the disengagement status of the clutch bevel gear of the present invention.
Figure 5:
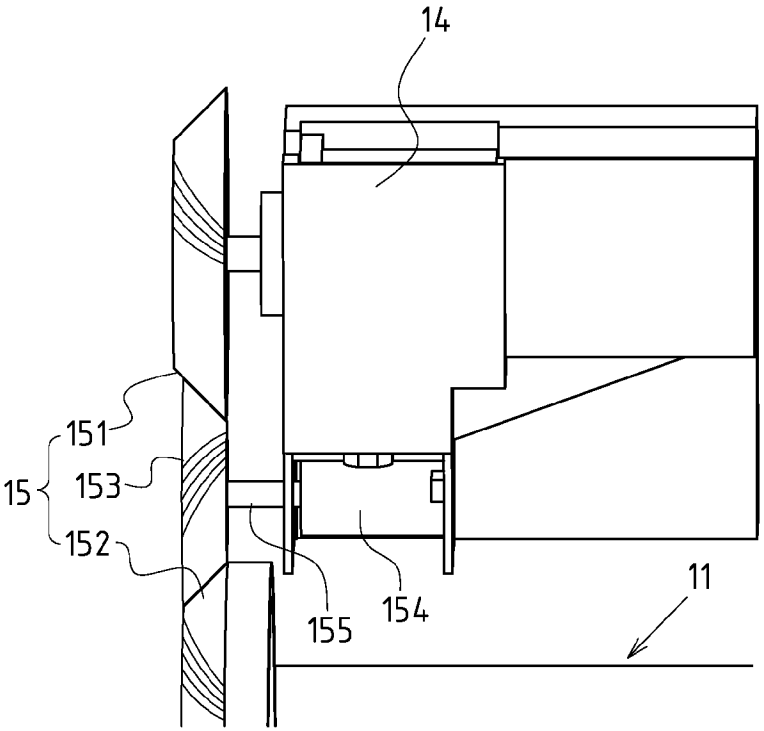
FIG. 5 is an elevation view of the meshing status of the clutch bevel gear of the present invention.

Furthermore, the gearing component 15 comprises a first bevel gear 151, a second bevel gear 152, a clutch bevel gear 153 between the first and second bevel gear 151, 152, and a solenoid valve 154. The first and second bevel gear 151, 152 and clutch bevel gear 153 are configured to be parallel on the axial direction. The first bevel gear 151 is driven directly by the driving motor 14, and the second bevel gear 152 is connected and fixed on one side of the water hose winding rack 11, with the tooth surfaces of the first and second bevel gear 151, 152 configured on the same direction, while the tooth surface of the clutch bevel gear 153 is configured on the opposite direction to mesh with the first and second bevel gear 151, 152. The solenoid valve 154 is connected to the clutch bevel gear 153 through a telescopic pole 155, so that the clutch bevel gear 153 can be driven by the solenoid valve 154 to mesh with (as shown in FIG. 5) or be disengaged from (as shown in FIG. 6) the first and second bevel gear 151, 152. The above structures constitute the present invention. Below is a description of the working situation of the present invention.

Figure 4:
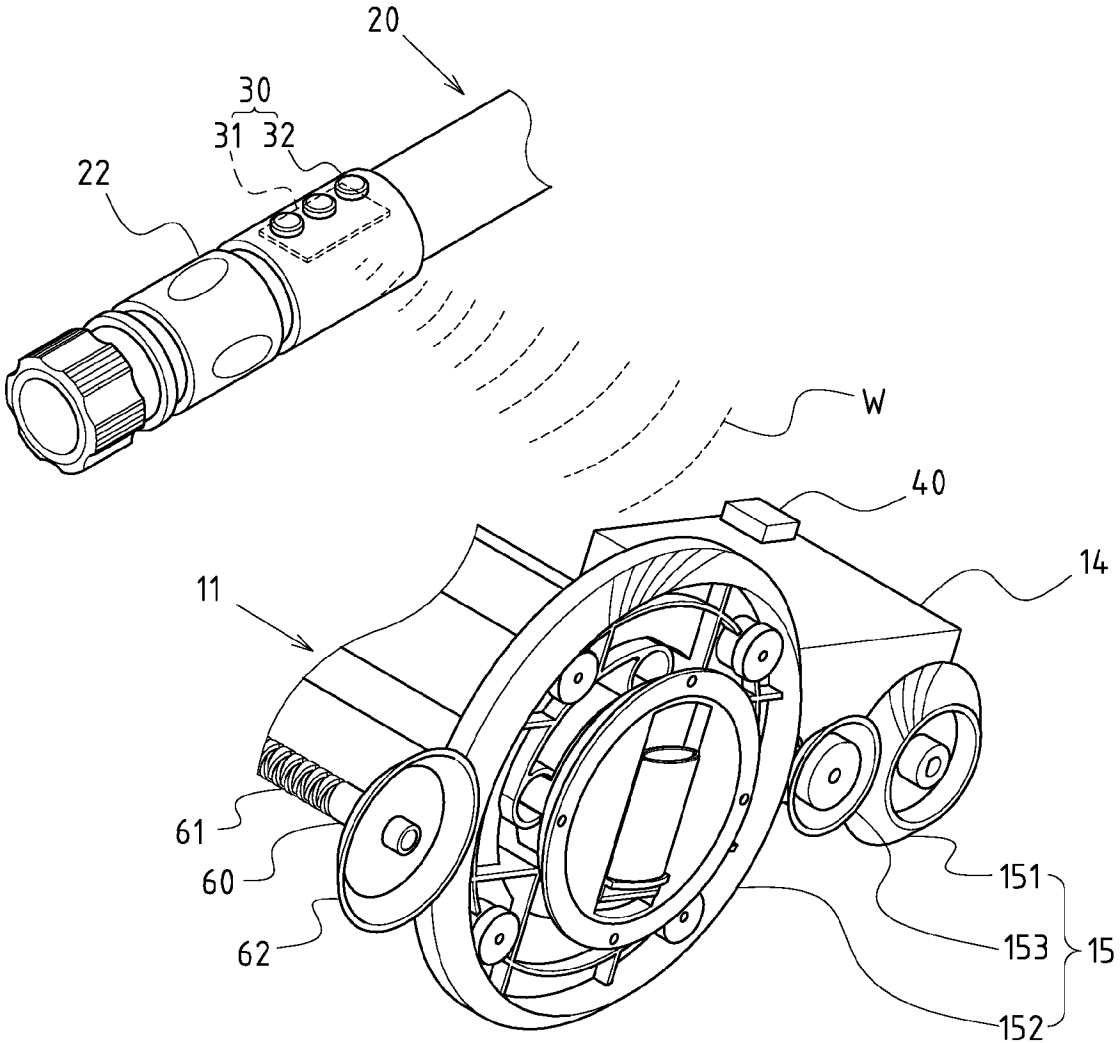
FIG. 4 is an illustration of the working status of the wireless winding control mechanism and driving end radio signal receiver of the present invention.
Figure 8:
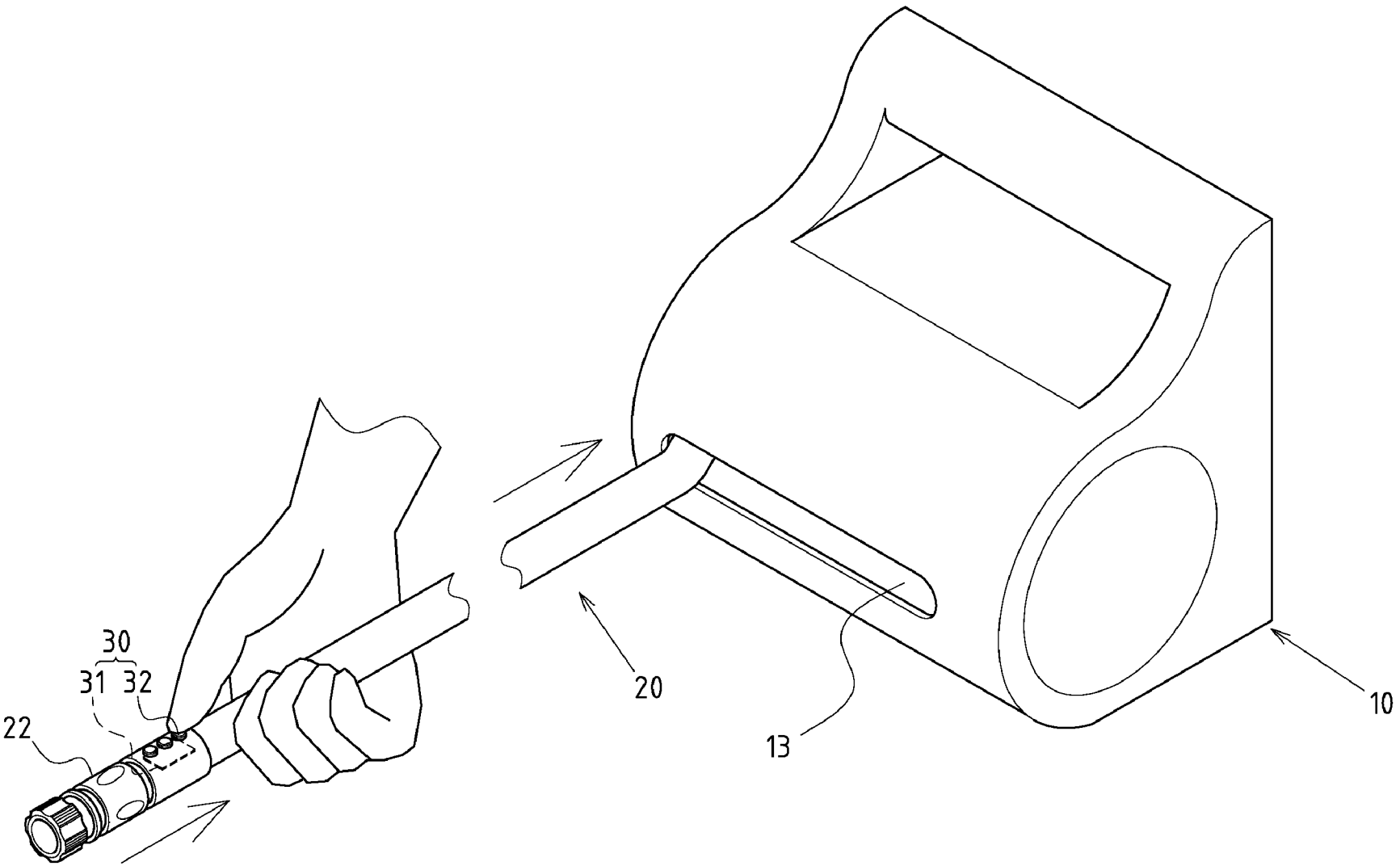
FIG. 8 is a schematic view of an illustration of the wind-up status of the water hose of the present invention.

As shown in FIG. 4, the core of the water hose winding device A disclosed in the present invention lies in that the water outlet end 22 of the water hose 20 is configured with the wireless winding control mechanism 30, and correspondingly the winding device main body 10 is configured with the driving end radio signal receiver 40. Based on this device, under the status that the water outlet end 22 of the water hose 20 is pulled out in use, when the user presses the control switch 32 of the wireless winding control mechanism 30 (as shown in FIG. 8), the radio signal transmitter 31 will transmit a wireless control signal W, which is received by the driving end radio signal receiver 40. Then the signal is converted into a command to activate the driving motor 14. After start of the driving motor 14, through the motion transmission of the gearing component 15, the water hose winding rack 11 will rotate and wind up the water hose. Of course, the control switch 32 of the wireless winding control mechanism 30 can further include a control switch to shut off the driving motor 14 (note: start or shut-off functions can be controlled by one single switch or two different switches). When the user wants to stop the winding of the water hose 20, he can also operate the control switch 32 on the water outlet end 22 of the water hose 20. Hence, it is very convenient to use.

Figure 7:
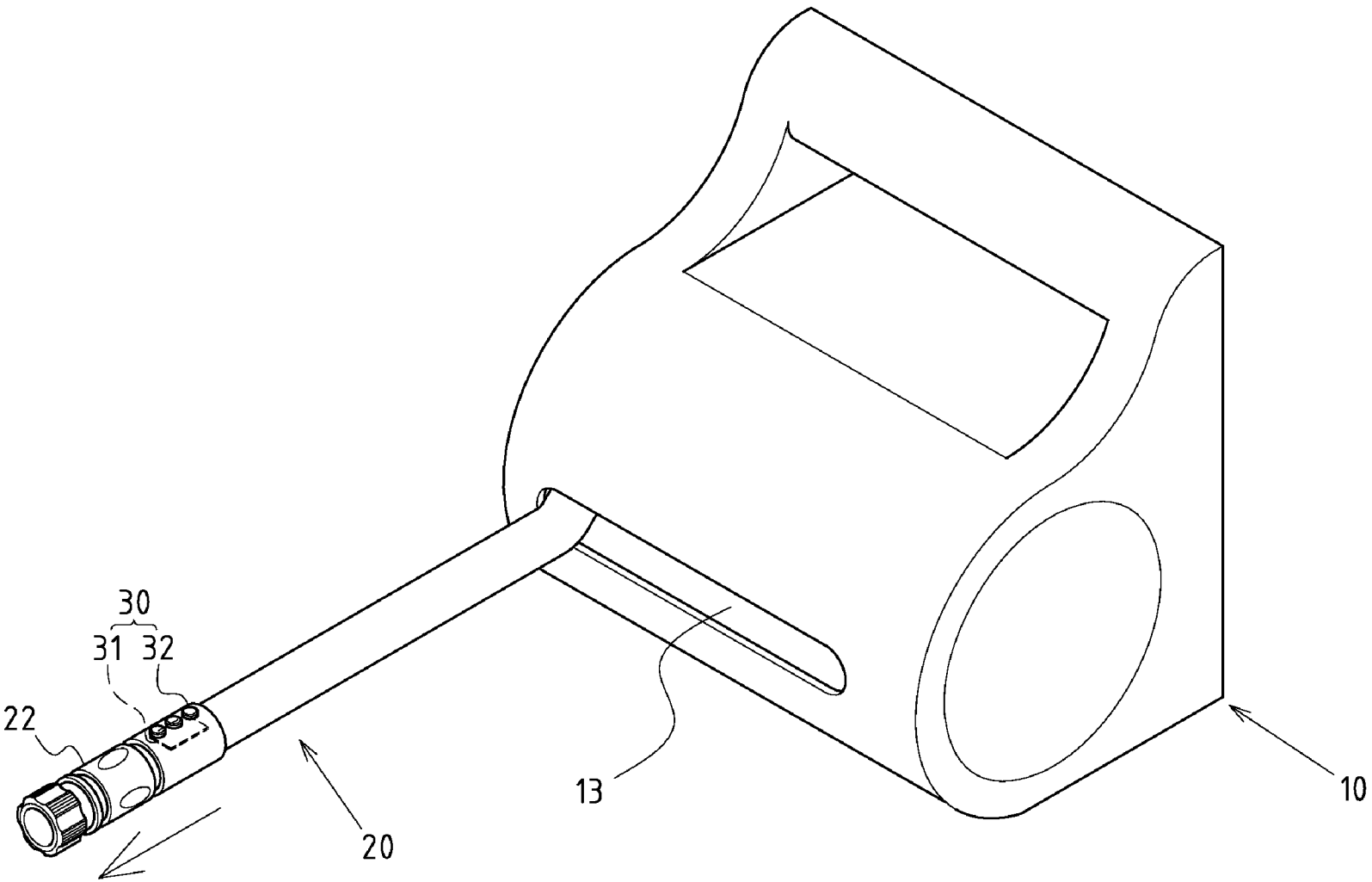
FIG. 7 is a schematic view of an illustration of the pull-out status of the water hose of the present invention.

The main objective of the invention is that the gearing component 15 be composed of the first bevel gear 151, second bevel gear 152, clutch bevel gear 153, and solenoid valve 154 is to considerably reduce the resistance when pulling out the water hose 20 and save labor. And the opening or closing of the solenoid valve 154 can also be controlled by the control switch 32 on the water outlet end 22 of the water hose 20 as mentioned above. For example, it can be such a device that, when the user presses the control switch 32, the clutch bevel gear 153 and the first and second bevel gear 151, 152 will mesh with each other (as shown in FIG. 5). While when the user does not press the control switch 32, the clutch bevel gear 153 and the first and second bevel gear 151, 152 will be disengaged from each other (as indicated by L1 in FIG. 6). Based on this, when the user wants to pull out the water hose 20, the water hose winding rack 11 will rotate independently without influence from the first bevel gear 151, the driving motor 14 or the clutch bevel gear 153, so that the water hose 20 can be pulled out (as shown in FIG. 7) more easily.

Figure 9:
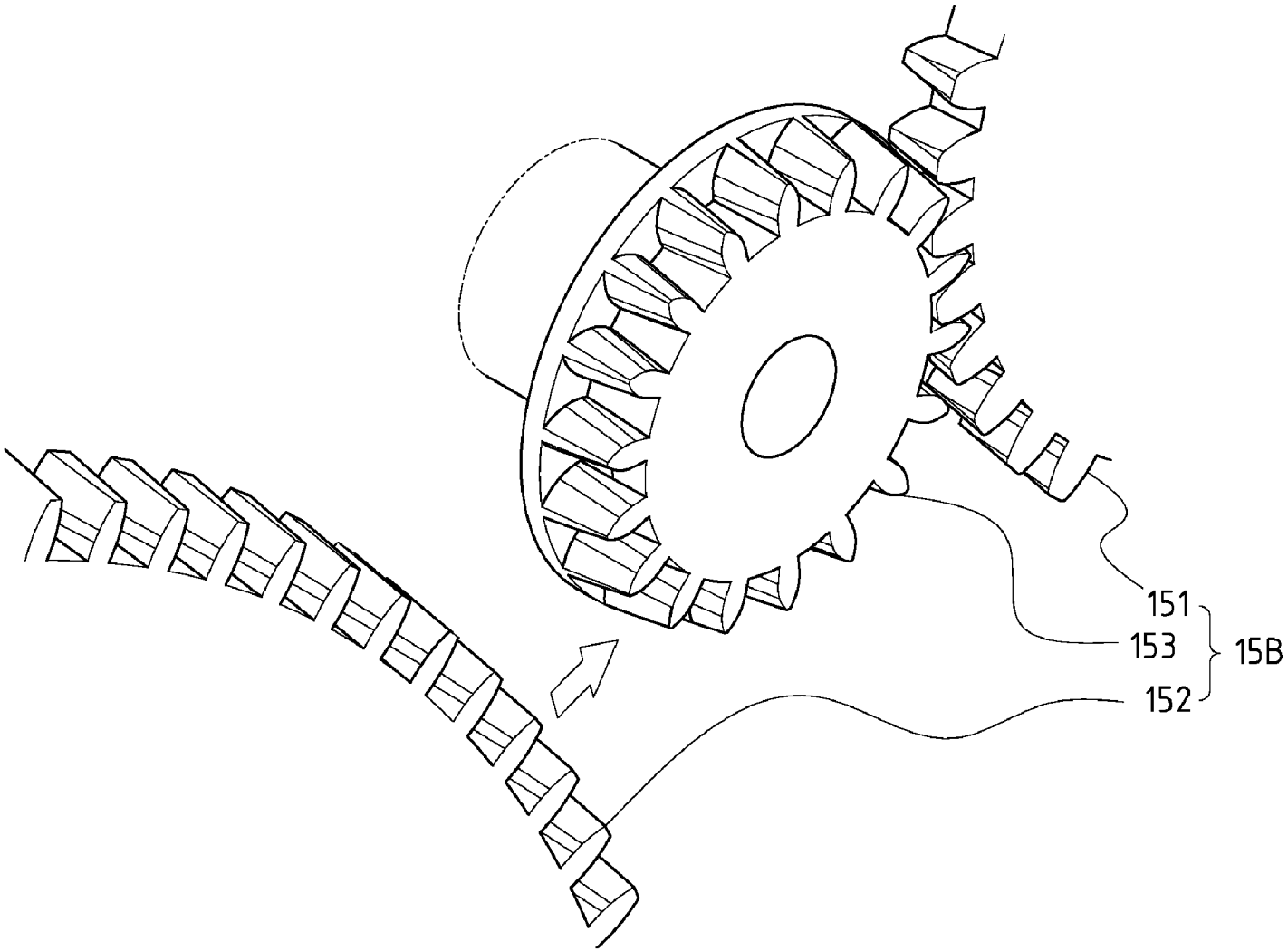
FIG. 9 depicts schematic view of another embodiment of the gearing component bevel gear of the present invention.

It is to be supplemented that, apart from umbrella-shaped gear (referring to FIG. 4 for detail) for motion transmission, the first bevel gear 151, second bevel gear 152 and clutch bevel gear 153 of the gearing component 15 can also adopt non-umbrella-shaped gear as disclosed in the gearing component 15B shown in FIG. 9. The first bevel gear 151, second bevel gear 152 and clutch bevel gear 153 are not umbrella-shaped gears, but the tooth surface is implemented as a bevel for motion transmission.

I claim:

1. A water hose winding apparatus comprising:

a main body having a winding rack and a water inlet adapter and an exit guide hole and a driving motor and a gearing component, said winding rack being rotatable, said driving motor being drivingly connected to said gearing component so as to cause said winding rack to rotate;

a water hose having a connection end and a water outlet end, said connection end being connected to said water inlet adapter, said water outlet end extending through and out of said exit guide hole, said water hose having a pipe body between said connection end and said water outlet end, said pipe body being windable on an exterior of said winding rack;

a guiding slider positioned within said exit guide hole, said guiding slider having a through hole through which said water hose extends, said guiding slider having a top end and a bottom end, said top end having an upper sliding support, said bottom end having a lower sliding support, said main body having an upper track and a lower track guidably connected respectively to said upper sliding support and said lower sliding support, said guiding slider having a driven through hole formed transverse at one end thereof, said main body having a driving shaft with biodirectional screws, said driving shaft being held by said driven through hole, said driving shaft having a driven part at one end thereof, said gearing component drivingly connected to said driven part so as to rotate said driven part, said gearing component comprising:

a first bevel gear;

a second bevel gear;

a clutch bevel gear positioned between said first bevel gear and said second bevel gear; and a solenoid valve, said first bevel gear and said second bevel gear and said clutch bevel gear being longitudinally axially parallel to each other, said driving motor directly driving said first bevel gear, said second bevel gear being fixed to one side of said winding rack, each of said first bevel gear and said second bevel gear having a toothed surface configured in the same direction, said clutch bevel gear having a toothed surface configured in a direction opposite to the direction of said toothed surface of said first and second bevel gears so as to mesh with said first and second bevel gears, said solenoid valve being connected to said clutch bevel gear through a telescopic pole such that said clutch bevel gear can be driven by said solenoid valve so as to mesh with or be disengaged from said first and second bevel gears;

a wireless winding control mechanism affixed on said water outlet end of said water hose, said wireless winding control mechanism having a radio signal transmitter and at least one control switch, the control switch suitable for causing said radio signal transmitter to transmit a wireless control signal; and a driving end radio signal receiver positioned on a main body, said driving end radio signal receiver receiving the wireless control signal transmitted by said radio signal transmitter, said driving end radio signal receiver being electrically connected to said driving motor, said wireless control signal suitable for causing said driving end radio signal receiver to start or stop said driving motor.

2. The apparatus of claim 1, said first bevel gear and said second bevel gear and said clutch bevel gear being umbrella-shaped gears.

3. The apparatus of claim 1, the teeth of said first bevel gear and said second bevel gear and said clutch bevel gear meshing with each other on a bevel.

* * * * *